US009908597B1

(12) United States Patent
Benson

(10) Patent No.: US 9,908,597 B1
(45) Date of Patent: Mar. 6, 2018

(54) MARINE LIGHT

(71) Applicant: T-H MARINE SUPPLIES, INC., Huntsville, AL (US)

(72) Inventor: R. Andy Benson, Springdale, AR (US)

(73) Assignee: T-H Marine Supplies, Inc., Huntsville, AL (US)

( * ) Notice: Subject to any disclaimer, the term of this patent is extended or adjusted under 35 U.S.C. 154(b) by 118 days.

(21) Appl. No.: 14/622,076

(22) Filed: Feb. 13, 2015

Related U.S. Application Data

(60) Provisional application No. 61/941,121, filed on Feb. 18, 2014.

(51) Int. Cl.

| | |
|---|---|
| ***B63B 45/04*** | (2006.01) |
| ***F21V 23/06*** | (2006.01) |
| ***F21V 3/00*** | (2015.01) |
| ***F21V 21/14*** | (2006.01) |

(52) U.S. Cl.
CPC ..... *B63B 45/04* (2013.01); *F21V 3/00* (2013.01); *F21V 21/14* (2013.01); *F21V 23/06* (2013.01)

(58) Field of Classification Search
CPC . B63B 45/04; F21V 3/00; F21V 21/14; F21V 23/06; F21V 21/116
USPC ..... 362/477
See application file for complete search history.

(56) References Cited

U.S. PATENT DOCUMENTS

| | | | | |
|---|---|---|---|---|
| 3,833,800 | A * | 9/1974 | Stewart | B63B 45/04 362/477 |
| 6,155,195 | A * | 12/2000 | Nirenberg | B60Q 1/2657 114/343 |
| 6,164,803 | A * | 12/2000 | Reniger | B60Q 1/2657 114/353 |
| 6,848,815 | B1 * | 2/2005 | Born | B63B 45/04 362/287 |
| 8,056,936 | B2 | 11/2011 | Peng | |
| 2013/0148375 | A1 | 6/2013 | Connor | |
| 2014/0192536 | A1 * | 7/2014 | Hsien | F21V 17/06 362/294 |

* cited by examiner

*Primary Examiner* — Elmito Breval
*Assistant Examiner* — Jessica M Apenteng
(74) *Attorney, Agent, or Firm* — Stephen H. Hall; Bradley Arant Boult Cummings LLP

(57) ABSTRACT

A flexible light structure for a marine light includes a flexible pole, a quick-connect base mount, and an impact-resistant light globe.

20 Claims, 4 Drawing Sheets

MARINE LIGHT

CROSS-REFERENCE TO RELATED APPLICATIONS

This application claims priority to and is a continuation-in-part of U.S. Provisional Patent Application Ser. No. 61/941,121 filed on Feb. 18, 2014, the disclosure of which is hereby incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of marine navigation safety lighting. In particular, the present invention relates specifically to flexible, durable, and impact resistant lighting.

2. Description of the Known Art

Marine navigation lights are well known. However, the existing lights can become easily damaged, potentially leaving boats without a bow and/or stern safety light in low light conditions.

The main problems to the existing lights include but are not limited to the potential for damage to the bulb or globe itself through cracking or shattering or to the pole through bending, breaking, denting or failure of crude electric connectors that easily break. Another concern is the mount for the light itself as existing mounts have crude electric connections that easily break.

Additionally, there is a potential to make a marine navigation light that is more aesthetically pleasing. Boat owners spend substantial amounts of money on their vessels to then outfit them with undependable, easily damaged lights. There is a potential to compliment the aesthetic quality of the boat while additionally providing a higher quality, useful marine light.

Examples of devices which may be related to the present invention include U.S. Pat. No. 8,056,936 to Peng issued Nov. 15, 2011; U.S. Pat. Pub. 20130148375 to Connor published Jun. 13, 2013. Each of these is hereby incorporated by reference in their entirety.

While these devices may be suitable for the particular purpose to which they address, they are not as suitable for providing a durable navigation marine light. In these respects, the navigation marine light according to the present invention substantially departs from the conventional concepts and designs of the prior art, and in so doing provides an apparatus primarily developed for the purpose of providing a flexible and durable impact resistant marine fixture.

SUMMARY OF THE INVENTION

The present invention is directed to a marine safety navigation light for mounting upon a marine craft, such as a boat. The primary objective is to provide a marine safety light that is flexible, durable and with improved function.

Light globes for safety lights should be durable for exterior use. Marine lights are often impacted by non-marine objects and marine gear, such as fishing poles or water skis. Impacts can shatter or crack existing marine light globes and/or bulbs. Therefore, it is an object of the present invention to provide a marine globe that is a compact design to minimize the surface area for impact. It is an object of the present invention to provide a globe with an impact resistant material to eliminate breakage. It is an object of the present invention to provide a globe with multiple efficient light emitting diodes (LEDs) to minimize bulb burn out. It is an object of the present invention to provide a water-proof and sealed globe to reduce the potential for water intrusion within the globe.

Pole structures for marine lights are historically not flexible. Those in the marketplace are thin hollow aluminum tubes. This leads to the potential for denting, damaging or breaking if the pole structure is impacted by a dock structure or marine gear. Aesthetically, the pole structures are also lacking. Boat owners can spend substantial amounts of their boats, but then outfit them with a cheap light. Therefore, it is an object of the present invention to provide an aesthetically pleasing and durable pole structure for a marine navigation light. It is an object of the present invention to provide a flexible pole structure to prevent breaking, but durable such that the pole does not arch excessively as a result of high boat speeds. It is an object of the present invention to provide a pole structure that can be easily customized for users.

Connections for marine lights to the boat mount and for the light itself can be difficult. Those known in the industry do not connect well and the multiple male/female connections can become easily broken. Therefore, it is an object of the present invention to provide a connection and boat mount for a light that is easy to connect. It is an object of the present invention to provide a connection that is waterproof. It is an object of the present invention to provide an easy alignment of the electrical connection to prevent breakages of the electrical connection.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
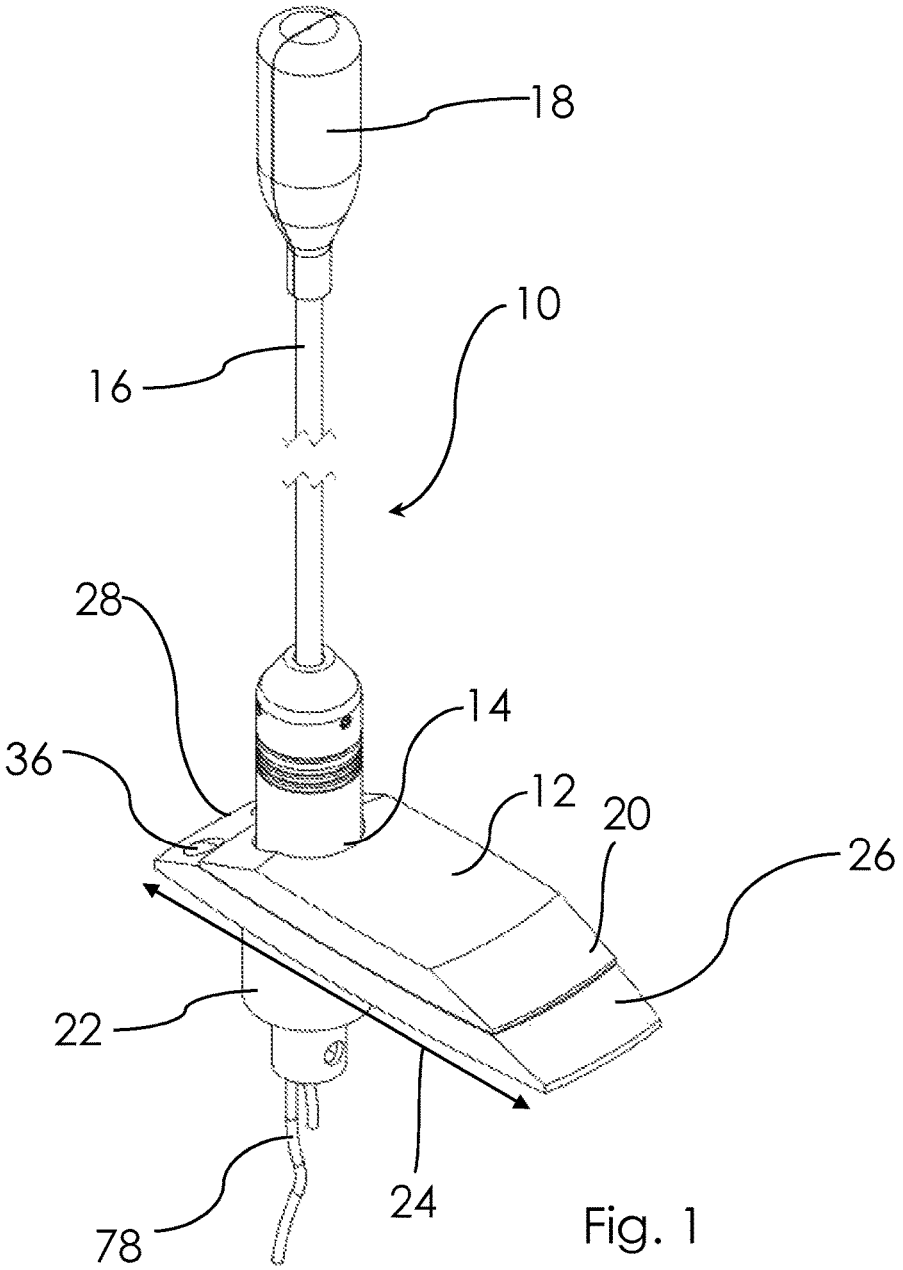
FIG. 1 is a perspective view of the invention.

As shown in FIGS. 1-6 of the drawings, one exemplary embodiment of the present invention is generally shown as a marine light 10 connectable to a marine craft through a mount 12 with a quick-release connection port 14 providing electrical connection to a globe light 18 having an pole extension 16 extending from the connection 14 to the globe light 18. Each of these elements will be discussed in turn.

Figure 2:
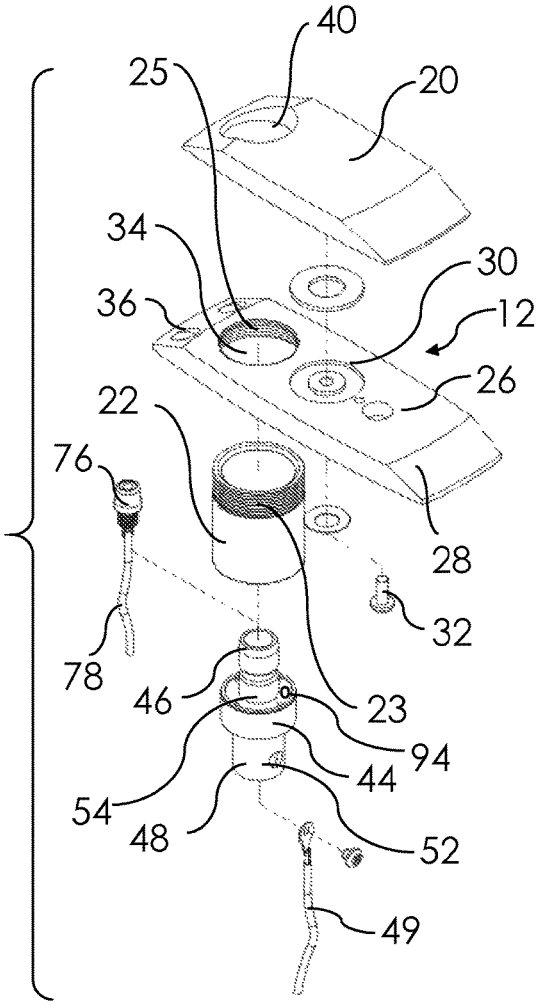
FIG. 2 is an exploded view of the base mount of the invention.
Figure 3:
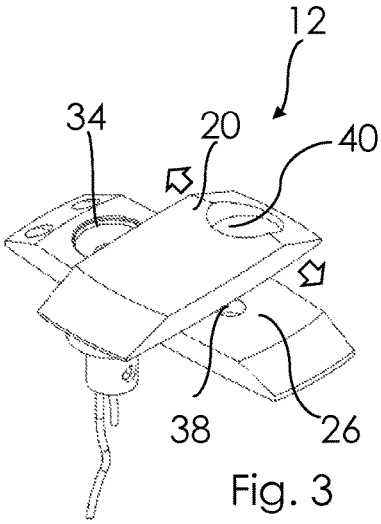
FIG. 3 is a perspective view of the base mount.

As shown in FIGS. 1-3, the base mount 12 has a top rectangular planar structure that provides a pivoting closure 20 to provide a water-proof environment for the electrical connections. The base mount 12 is constructed of a stainless steel material or similar material suitable for wear within a marine environment. It will be understood by those of ordinary skill in the art that other shapes of the base mount 12 may be employed depending upon the primary benefits and performance desired.

As shown in FIGS. 1-3, the base mount 12 is connection to a cylindrical structure that forms an electrical conduit 22 that extends perpendicular to the longitudinal axis 24 of the base mount 12. The electrical conduit is configured to engage the electrical port (not shown) of a boat and house the quick-release connection 14. As shown in FIG. 2, the electrical conduit 22 has a top portion and a lower portion, the top portion having a thread end connecter 23 to engage a threaded opening connection 25 on the base mount 12.

The top portion of the base mount 12 includes a rectangular planar base 26 having angled side edges 28 and a top planar surface 30 having an opening 40. It will be understood by those of ordinary skill in the art that other shapes of the planar base 26 may be employed depending upon the primary benefits and performance desired. The planar base may additionally include fastener ports 36 on the side edges 28 for securing other attachments. A rotating lid 20 is pivotally secured to the planar base 26. The rotating lid 20 is configured to rotate about a pivot point 32 from an open position (shown in FIG. 1) with the rotating lid 20 covering the top surface 30 or a substantial portion of the top surface 30 and the opening 40 aligning with the threaded opening 34 to a partially open position (shown in FIG. 3) to a closed position (not shown). As shown in FIG. 2, the pivot point 32 is a fastener secured through the base 26 of the mount 12 and connected to the top 20 of the mount. The rotating lid 20 may be secured from pivoting from the top surface 30 through use of a detent device 38 such as a set screw, ball and detent or other suitable mechanism to engage an access port 40 located on the lid 20. This same access port 40 provides access to the electrical connections within the mount 12 through the threaded opening 34.

Connections for marine lights to the boat mount and for the light itself can be difficult. Those known in the industry do not connect well and can become easily broken. The present invention features a single male-female connection within a single exterior male-female connection to provide a durable connection. The quick-release connection provides a connector 44 for engagement with a pole connection 56 within a sleeve engagement 50 to provide a water-tight environment for the connection.

As shown in FIG. 2, the quick-release connector 44 is shown housed within a conduit 22. The connector 44 consists of a top exterior male connection 46 which is configured to connect to the pole connection 56 within the conduit 22 and a conduit connection 48 configured to connect with the vehicle wiring (not shown). The connector 44 may be exchangeable to fit specific wiring components of different marine crafts. The connector 44 may include a base aperture to allow for moisture within the connection 14 to escape.

The connector 44 is a tubular structure configured to fit within the electrical conduit 22 of the base mount 12. The connector 44 has a mount end 52 and a connector end 54, each end configured for electrical access. The connector end 54 is configured to mate with the female end 56 of the globe connection 98 shown in FIG. 4. The pole extension 16 secures to the pole end 58 of the globe connection 98. It is envisioned that the male/female connections of the connector 44 and pole connection 56 may be reversed.

The connector 44 includes a LED or similar light 94 connected to the wiring of the vehicle. It is envisioned that the connector light 94 can be activated by pressing the NAV light or similar button on the vehicle dash (not shown). In this manner, the connector light 94 will become illuminated to allow for a user of the mount to see the conduit for connection of the pole extension 16 in low light conditions. As the connector 44 is within the conduit 22, the conduit 22 becomes illuminated.

Figure 5:
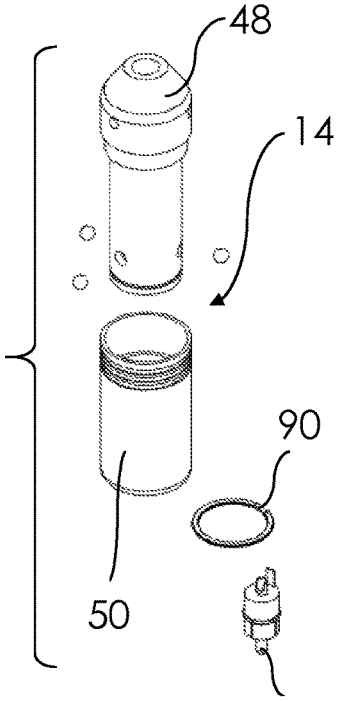
FIG. 5 is an exploded view of the marine light conduit fixture as it relates to the base mount.

The pole coupler sleeve 50 shown in FIG. 5 is configured to fit around the exterior of the globe connection 98 to provide a water-tight environment within the connection 14. An o-ring 90 or similar structure is provided within the sleeve 50.

Within the exterior male connection 46, an interior female connection 76 or similar connection is housed. The interior female connection 76 has a first end configured to electrically connect to the wiring components of the marine vehicle via the electrical wiring 78 attached to the connection 76. The second end of the interior female connection 76 is configured to connect with an interior male connection 80, shown in FIG. 5 and discussed further below. When the quick-release connection 14 is inserted into the base mount 12, the exterior male connection 46 engages the base 98 of the pole 16 to further engage the interior female connection 76 with the interior male connection 80.

Figure 6:
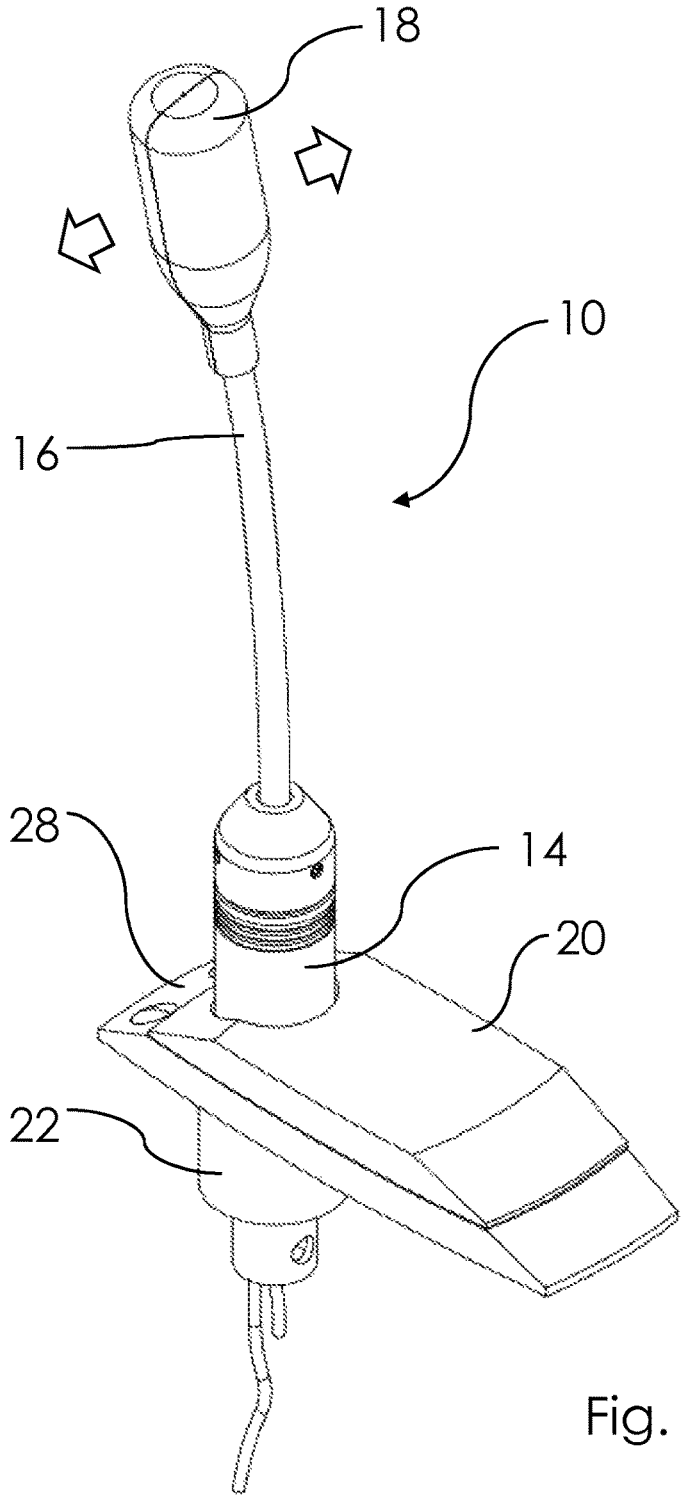
FIG. 6 is a perspective view of the invention showing the movement of the light pole.

The pole extension 16 is composed of a flexible fiberglass or similar flexible material. The flexibility of the material allows the pole extension to flex upon impact to avoid breaking, as shown in FIG. 6. The fiberglass material is configured to allow heat shrink tubing, graphic print, design, wording or insignia to be printed upon the material prior to attachment to the connection 14. In this manner, the pole extension 16 may be decorated with a graphic design (not shown). The pole extension 16 extends from a first end 52 to a second end a length 90. Such length 90 may be between 1 foot to 4 feet. The pole extension 16 extends from a coupler end 54 to a light globe end 52.

A light globe 18 are secured to the light globe end 52 and configured to receive electrical access through the light globe end 52 to illuminate the globe 18. The light globe is composed of an impact-resistant material to reduce the potential for breakage when impacted.

Figure 4:
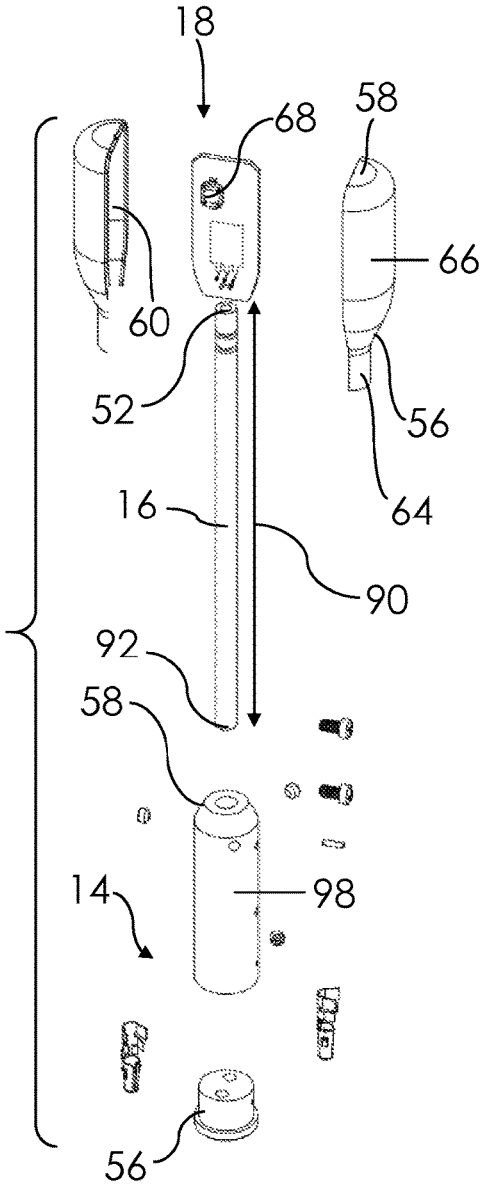
FIG. 4 is an exploded view of the alternative connecting base of the marine light.

As shown in FIG. 4, the globe has a pole end 56 and a top 58 spaced apart from the pole end 56. The globe 18 may house multiple lights 68, such as LED bulbs. The pole end 56 of the globe 18 securely fastens to the pole extension 16 and may be fastened with an adhesive and shrink tube wrapping. Alternatively, the globe 18 may be secured through use of a set screw or detent fastener. The shrink tube wrapping may feature a graphic design as well.

The globe 18 has a neck 64 extending from the pole end 56 to cylindrical body 66. The globe may be a colored material or have a clear wrap material that imparts a tint to the globe 18. The wrap material 68 may be placed around the body of the globe above the neck 64 portion. Alternatively, colored LEDs may be used.

The uses and operation of the marine light are clear from above. The light 10 is positioned on the mount 12 on any desired location on the boat in accordance with U.S. Coast Guard regulations. The globe 18 is energized through electrical leads (not shown) through the connection 14 and the pole extension 16.

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically referring to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures.

What is claimed is:

1. A light system for a marine craft, comprising:

a base mount comprising a base mount top portion and a base mount bottom portion and a base mount opening;

an electrical conduit connected to said base mount and extending from, and positioned below, said base mount bottom portion;

a connector at least partially housed within said electrical conduit, said connector having a mount end and a connector end, said connector end comprising an exterior male connection, wherein said exterior male connection forms a lip positioned above a recess in the connector end, and wherein a first electrical connector is housed within said connector end;

a flexible pole having a proximal and a distal end and extending a length between said proximal and said distal ends, said proximal end having a second electrical connector configured to engage said first electrical connector; and a light globe secured to said distal end of said flexible pole.

2. The light system of claim 1, further comprising a globe connection configured to receive and secure the proximate end of said flexible pole, wherein said globe connection has a female connection configured to engage said exterior male connection of said connector to secure said globe connection to said connector.

3. The light system of claim 2, further comprising a pole sleeve configured to fit around the exterior of the globe connection, said pole sleeve having a proximal end and a distal end, said distal end configured to engage within said electrical conduit.

4. A light system for a marine craft, comprising:

a base mount comprising a base mount top portion and a base mount bottom portion and a base mount opening;

an electrical conduit connected to said base mount;

a connector at least partially housed within said electrical conduit and positioned below said base mount top portion and base mount opening, said connector having a mount end and a connector end, said connector end comprising a first connection interface, and wherein a first electrical connector is housed within said connector end;

a flexible pole, said pole having a proximal and a distal end and extending a length between said proximal and said distal ends, and a second electrical connector positioned at said proximal end of said flexible pole;

a globe connection configured to receive and secure the proximal end of said flexible pole, wherein said globe connection has a second connection interface configured to engage said first connection interface of said connector to secure said globe connection to said connector; and a light globe secured to said distal end of said flexible pole.

5. The light system of claim 4, wherein said first connection interface is a male connection and said second connection interface is a female connection.

6. The light system of claim 4, further comprising a pole sleeve configured to fit around the exterior of the globe connection.

7. The light system of claim 6, further comprising a lid structure which aligns with said base mount opening when said lid structure is in a closed position.

8. The light system of claim 4, wherein at least one of said first connection interface and said second connection interface comprises an exterior male connection, wherein said exterior male connection forms a lip positioned above a recess, and the other of the at least one of said first connection interface and said second connection interface is configured to engage said exterior male connection.

9. The light system of claim 8, further comprising a pole sleeve configured to fit around the exterior of the globe connection.

10. The light system of claim 9, wherein said pole sleeve has a proximal end and a distal end, and said distal end is configured to engage within said electrical conduit.

11. The light system of claim 4, said connector further having a connector light housed in the connector.

12. A light system for a marine craft, comprising:

a base mount having a base mount top portion and a base mount bottom portion and a base mount opening extending from the base mount top portion to the base mount bottom portion;

an electrical conduit extending from said base mount bottom portion, and positioned below said base top portion;

a connector at least partially housed within said electrical conduit and positioned below said base mount top portion, said connector having a top exterior male connection and a bottom conduit connection;

a first electrical connector housed within said connector and positioned in said top exterior male connection of said connector;

a flexible pole having a proximal and a distal end and extending a length between said proximal and said distal ends, said proximal end having a second electrical connector configured to engage said first electrical connector housed within said connector;

a globe connection configured to receive and secure said flexible pole, wherein said globe connection has a female connection configured to engage said top exterior male connection of said connector to secure said globe connection to said connector, wherein said base mount opening is configured to receive said globe connection; and a light globe secured to said distal end of said flexible pole.

13. The light system of claim 12, said flexible pole further comprising an exterior design element.

14. The light system of claim 12, further comprising a pole sleeve configured to fit around the exterior of the globe connection.

15. The mount of claim 12, wherein the base mount opening is threaded and the electrical conduit is threaded, and the electrical conduit is removeably attachable to said base mount opening.

16. The mount of claim 12, further comprising a lid structure connected to the base mount that is selectively moveable from an open position and a closed position, wherein the lid structure covers said base mount opening when said lid structure is in a closed position and leaves the base mount opening uncovered in an open position.

17. The light system of claim 12, wherein the base mount has fastener ports.

18. The light system of claim 12, further comprising a pole sleeve configured to fit around the exterior of the globe connection, a lid structure which aligns with said base mount opening when said lid structure is in a closed position, and wherein the base mount has fastener ports.

19. The light system of claim 18, wherein the connection between the pole sleeve and globe connection is water-tight.

20. The light system of claim 12, said connector at least partially housed within said electrical conduit has a connector light.

* * * * *